US005131579A

United States Patent [19]

Okushima et al.

[11] Patent Number: 5,131,579

[45] Date of Patent: Jul. 21, 1992

[54] NAILING MACHINE

[75] Inventors: Hideki Okushima; Toshio Yamada, both of Tokyo, Japan

[73] Assignee: Max Co., Ltd., Tokyo, Japan

[21] Appl. No.: 674,311

[22] Filed: Mar. 25, 1991

Related U.S. Application Data

[63] Continuation of Ser. No. 236,919, Aug. 26, 1988, abandoned.

[30] Foreign Application Priority Data

Mar. 2, 1988 [JP] Japan ..... 63-27970[U]
Mar. 2, 1988 [JP] Japan ..... 63-27971[U]

[51] Int. Cl.[5] ..... B25C 1/04
[52] U.S. Cl. ..... 227/8; 73/210; 227/130
[58] Field of Search ..... 227/8, 130; 173/139

[56] References Cited

U.S. PATENT DOCUMENTS 4,091,981 5/1978 Moriguchi et al. ..... 227/8
4,566,619 1/1986 Kleinholz ..... 227/130 X

*Primary Examiner*—Hien H. Phan
*Attorney, Agent, or Firm*—Cushman, Darby & Cushman

[57] ABSTRACT

A nailing machine having a cylinder housing which houses a cylinder which slidably houses a piston in communication with a source of compressed fluid for moving the piston within the cylinder, and a nail machine body which integrally includes a grip portion. A nail magazine and a nail feeder cooperate to feed a nail to the injection portion of the nailing machine. A bumper is arranged to collide with the lower surface of the piston during the nailing operation. The cylinder housing is coupled with the nail machine body so as to be movable in a nail-driving direction. A nail driver is in communication and moves integrally with the piston. A compressed fluid communication chamber is formed between the grip portion and the nailing machine body to move the piston and thereby the nail drives in a nail-driving direction.

11 Claims, 5 Drawing Sheets

NAILING MACHINE

This is a continuation of application No. 07/236,919, filed on Aug. 26, 1988, which was abandoned upon the filing hereof.

BACKGROUND OF THE INVENTION

The present invention relates to a nailing machine and holder and more particularly to a nailing machine and holder in which compressed fluid is used to move a driving member in the nailing machine to drive a nail.

In certain kinds of nailing machines, nails are driven by a driver incorporated in a piston driven within a cylinder by high-pressure compressed fluid. The fluid is rapidly introduced into an upper portion of the cylinder so that the piston within the cylinder is driven downward by the pressure of the compressed fluid to hit a nail set in an injection portion to thereby inject the nail toward and into a driven member. However, the pressure of the high-pressure fluid introduced into the cylinder not only acts on the upper surface of the piston to drive the piston downward, but also acts on the opposing upper bottom surface of the cylinder. Accordingly, the cylinder is lifted up by the reaction force of the fluid pressure so that the cylinder housing tends to jump up separating the forward end of the injection portion from the surface of the driven member so that it is difficult to perform exact driving.

In order to prevent such jumping-up, nailing may be done while the upper portion of the cylinder housing is pressed down by hand. However, the driving depth of the nail changes in response to the magnitude of the pressing force, and accordingly, in the conventional nailing machine, the driving depth of the nail changes depending on whether the cylinder housing or is not pressed. When pressed, the driving depth changes corresponding to the magnitude of the pressing force. For example, when a gypsum board is nailed onto a wood surface, the nail head often projects too much from the surface of the gypsum board or sinks into the gypsum board too deeply to break a sheet of paper provided at the surface of the gypsum board. If the nail head projects too much, the nail head will interfere with the work of covering the gypsum board with cloth. If the nail head sinks too deep, the shape-retaining force of the gypsum board will be lost. Therefore, in the conventional nailing machine, controlling the depth of penetration of the nail is difficult. It is therefore desirable to have a nailing machine in which the nail is always driven exactly and uniformly to a certain depth.

Generally, when a nailing machine is operated, a rebound results as compressed air forced into the cylinder acts on the upper surface of the nail-driving member within the cylinder to move the driving member downward, and the compressed air acts as a reaction force on the upper wall of the cylinder to move the cylinder upward. When the nailing machine is moved upward by the rebound, a bottom dead point of the nail-driving member is moved upward, so that the impact force is reduced. Of course, the influence of the rebound can be reduced by a worker pressing the nail machine onto the driven member to control the quantity of displacement of the nailing machine. However, in this situation uniform driving is impossible because the driving force changes corresponding to the magnitude of the pressing force.

Generally, in the conventional nailing machine for driving a nail having a round-form enlarged head portion, the inner diameter of the nose portion for driving out the nail is established to be slightly larger than the diameter of the head portion of the nail. Thus, because the forward end portion of the nail can move freely within the nose portion, the nail is driven obliquely. This tendency is remarkable in a gypsum board nail which is larger in head diameter than an ordinary nail. Furthermore, gypsum board requires a nail to be driven in a perpendicular posture more exactly than the ordinary nail, because reinforcement paper on the surface of the gypsum board may be broken by the edge of an inclined nail head.

Therefore, a holding-guiding mechanism for guiding the forward end portion of a nail driven out by the nose portion of the nailing machine to the central position of the nose portion and for holding the nail in a perpendicular posture has been proposed, for example, as disclosed in Japanese Patent Post-Examination Publication No. 56-20153 (1981). However, because the nail holding-guiding mechanism is provided in the inside of the nose portion of the nailing machine, the outer diameter of the nose portion is rather large, and it is difficult to ascertain where the nail-driving portion is. Consequently, handling of the nail machine is somewhat difficult.

The same technique as described above has also been disclosed in Japanese Utility Model Unexamined Publication No. 51-79783 (1976). Because the nail holding-guiding mechanism partly projects at the forward end of the nail-driving-out nose portion, the holding-guiding elements are arranged to be in direct contact with the surface of the driven member. When, for example, the position of the nose portion is shifted laterally, the holding-guiding elements are opened, so that the nail may be inclined. When, for example, the nail is rapidly driven out, the respective holding-guiding elements are impulsively opened. Because the nailing machine has no means for preventing the opening of the respective elements, an elastic member urging the elements to be closed is excessively expanded and displaced. Consequently, durability is impaired.

SUMMARY OF THE INVENTION

It is an object of the present invention to provide a nailing machine for driving a nail to a uniform depth.

It is also an object of the present invention to provide a non-reaction nailing machine in which a compression spring for urging the body to return to the bottom dead point is not used, so that the machine can be small in size.

It is also an object of the present invention to provide a non-reaction nailing machine in which the air supply mechanism between the grip portion and the body is simplified in construction, so that the body glides smoothly and durability is improved.

It is a still yet a further object of the present invention to provide a non-reaction nailing machine in which the movement of the body can be supported stably and in which air supply/exhaust between the grip portion and the body can be carried out without use of outside piping.

These and other objects of the present invention are achieved by a nailing machine comprising a cylinder housing including a piston provided with a driver for driving a nail, a cylinder slidably housing the piston, and a head valve for controlling supply and exhaust of compressed air into and from the cylinder; a nailing machine body integrally including a grip, a nail magazine, a nail feed means for feeding a nail to a nail injection portion, a bumper means arranged to collide with a lower surface of the piston for absorbing impact of the piston at the time of nailing, and a nail injection portion for driving out a nail fed thereto by the nail feed means, the cylinder housing being coupled with the nailing machine body so as to be movable in a nail-driving direction, so that the piston within the cylinder can be driven downward by compression fluid to cause the driver to drive a nail.

In the above-nailing machine according to the first aspect of the present invention, when a nail injection operation is carried out, the piston within the cylinder is driven downward by compressed fluid poured into the cylinder and, at the same time, the cylinder housing is lifted up by the reaction force of the compressed fluid. Because the cylinder housing is, however, slidable in the nail-driving direction relative to machine body, the nailing machine body is kept still in spite of the lifting-up of the cylinder housing, so that the injection portion can also be kept in a contacting posture with respect to the driven member. Accordingly, exact nailing can be made. Because the nailing machine body does not move, there is no necessity for pressing the nail machine body by hand. Further, because the driving depth of the nail does not change corresponding to whether the body is pressed by hand or not, the nail can always be driven to a constant depth.

A second embodiment of the first aspect includes a first movable pipe body for connecting a trigger valve of the nailing machine body to one end of the head valve of the cylinder housing so as to give a nail-driving signal to the head valve; and a second movable pipe body housed in the nailing machine body for connecting a compressed fluid supply source to the opening of the cylinder of the cylinder housing and to the other end of the head valve.

Because the first and second movable pipe bodies for connecting the nailing machine body to the cylinder housing can absorb the relative movement of the nailing machine body and the cylinder housing, the operation of the nailing machine is always smooth.

A third embodiment of this first aspect of the invention includes a positioning means for keeping the relative position of the nailing machine body and the cylinder housing constant at all times. Because the nailing machine body and the cylinder housing are positioned in a predetermined positional relationship by the positioning means after they have moved relative to each other during the nailing operation, the nailing machine can always be operated smoothly.

A second aspect of the present invention includes a grip portion having a starting trigger valve; a body having a nail-driving member slidably provided in the body, the grip and the body being arranged to be movable relative to each other in a nail-driving direction; and a compressed air communication air chamber formed between the grip portion and the body, the air chamber being provided with a difference in effective area to urge the body to move toward a nail-driving side so as to supply compressed air within the air chamber into the body to thereby drive the driving member.

As described above, in the non-reaction nailing machine according to the second aspect of the present invention, the communication air chamber is formed between the grip portion and the body, so that the communication between the grip portion side and the body side can be maintained even though the body moves relative to the grip portion. Because the air supply/exhaust between the grip portion and the body can be made without outside piping, the body can slide smoothly, thereby making maintenance easy and improving durability.

Because of the difference in the effective area of the compressed air formed in the communication chamber, the body which has moved at the time of nailing is returned to its initial position by supplying compressed air to the communication air chamber. For this reason, the second embodiment does not require a compression spring for urging the body to return to its initial position in the nailing machine according to the first aspect of the present invention. Consequently, the machine can be reduced in size.

A second embodiment of the second aspect of the present invention includes a nose portion forming a nail injection outlet, a trigger valve for controlling starting air, and a hollow grip portion connected to a compressed air supply source; a body having a cylinder for slidably housing a nail-driving member, and a head valve arranged to be opened and closed by the supply and exhaust of the compressed fluid from the trigger valve to control driving air for the nail-driving member, the body being supported slidably in a nail-driving direction relative to the nose portion, the body being fitted into an annular portion formed in the grip portion so as to be supported by the annular portion; and a slide seal provided between the body and the annular portion so that the starting air from the trigger valve and the driving air from the grip portion communicate with the body through the slide seal.

In the non-reaction nailing machine according to the second embodiment of the second aspect of the present invention, the body moves relative to the grip portion and the nose portion when a nail is driven. Because the body is, however, supported by engagement between the nose portion and the annular portion, stable support can be attained. Further, within the aforementioned limit of the relative movement, the starting air path and the starting air chamber communicate with each other through the slide seal, whereas the air chamber in the grip portion and the main air chamber also communicate with each other through the slide seal. For this reason, the communication between the starting air path and the starting air chamber and the communication between the air chamber on the grip portion and the main air chamber can be maintained in spite cf the relative movement of the body. Because air supply and exhaust between the grip portion side and the body side can be made without providing outside piping, the body is slid smoothly, thereby making maintenance easy and improving durability.

According to the third aspect of the present invention, the nailing machine includes a driver member for driving out a nail; a nose portion having a driving path for slidably housing the driver member therein; and a safety device having a cylindrical engagement portion which is disposed at a forward end of the nose portion, the cylindrical engagement being normally located in a position further projected than the forward end of the nose portion, which is engaged with a surface of a driven member so as to be movable in the axial direction of the nose portion and so as to enclose the nose portion, the nail holder comprises: a plurality of nail guide elements provided in the forward end of the nose portion at an outer circumference thereof, the nail guide elements having respective forward end portions further projected than the forward end of the nose portion and pivoted so as to be opened and closed between a position of advance into the direction of extension of the driving path of the nose portion and another position of escape from the direction of extension of the driving path; and an elastic means for urging the guide elements to move in the closing direction so that it is made possible to hold a nail within the driving path in the inside of the guide elements, and when the engagement portion of the safety device engaged with a surface of a driven member moves in the axial direction of the nose portion, the guide elements are housed in the inside of the nose portion so as to receive the guide elements opened for nail driving.

In the nail holder of the nailing machine according to the third aspect of the present invention, the respective forward end portions of the guide elements are normally in a closed state. For this reason, when nail driving is begun, the forward end of the nail within the driving path of the nose portion is caught by the forward end portions of the guide elements so that the shaft portion of the nail is kept in the center of the driving path. Accordingly, the nail is driven exactly in the axial direction of the nose portion.

Further, when the nail is driven out of the nose portion, the engagement portion is engaged with the driven member and moves in the axial direction of the nose portion, so that the safety device is released. After the releasing of the safety device, the driver member is driven to hit the nail. The nail then forces the guide elements to be opened impulsively and then the nail is driven out of the guide elements. Although the guide elements are rapidly opened, the guide elements are caught by the inner surface of the engagement portion so that the opening operation of the guide elements is limited. Because such an unnatural load exceeding the elastic limit is not imposed on the elastic means for urging the guide elements, durability can be improved.

Further, the engagement portion of the safety device used in the conventional nailing machine can be used in this embodiment without modifications. Accordingly, there is no necessity for increasing the outer size of the nose portion, so that operativity cannot be lowered.

BRIEF DESCRIPTION OF THE DRAWINGS

Other features and advantages of the present invention will be apparent from the following description taken in connection with the accompanying drawings, wherein.

DETAILED DESCRIPTION OF THE PREFERRED EMBODIMENTS

A first embodiment of the present invention will be described with reference to the drawings.

Figure 1:
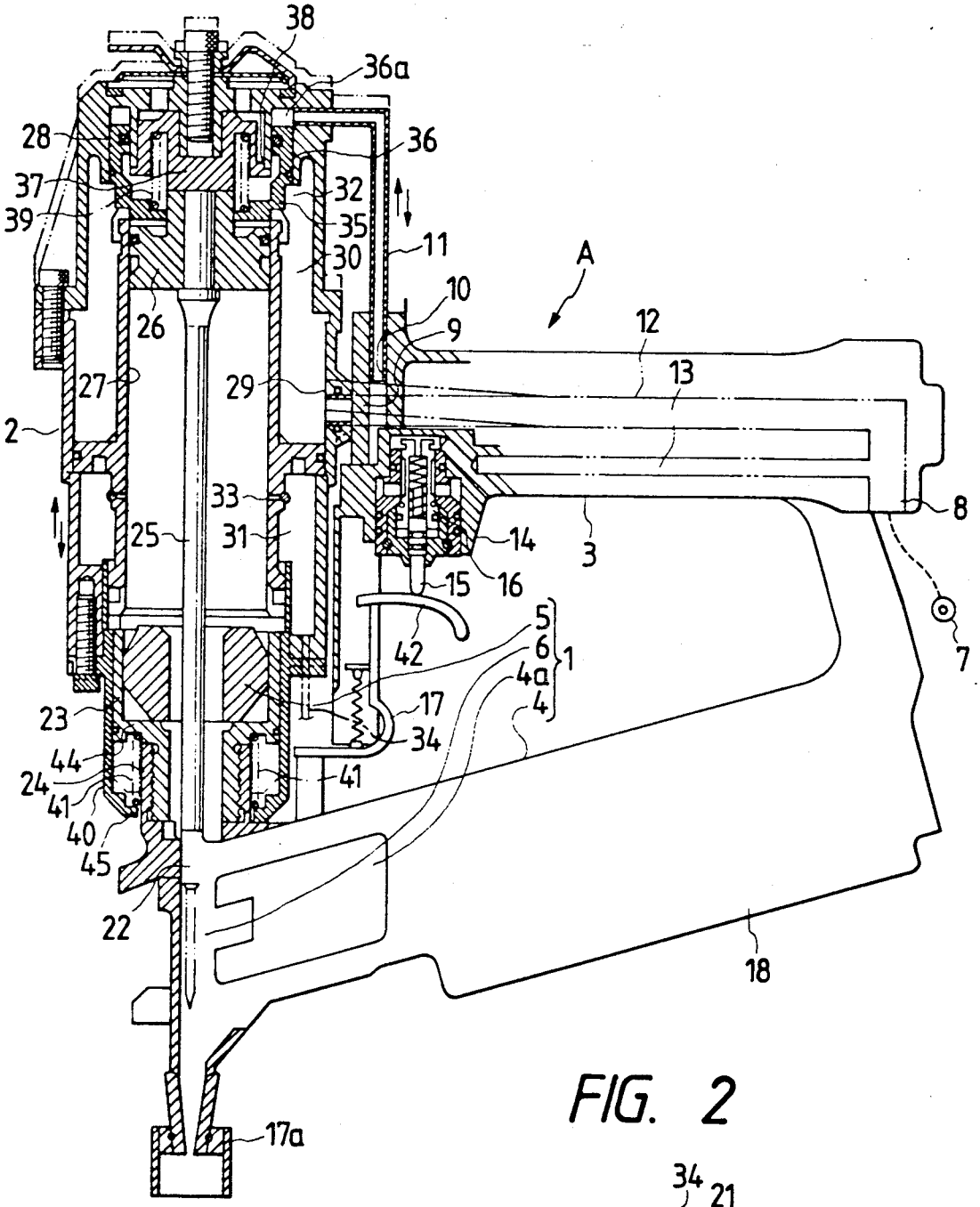
FIG. 1 is a longitudinal section of a nailing machine as a first embodiment according to the present invention.

In FIG. 1, a nailing machine A driven by compressed air is constituted mainly by a nailing machine body 1 and a cylinder housing 2.

The nailing machine body 1 is formed by the integral combination of a grip 3, a nail magazine 4, a nail feed means 4a for feeding a nail to an injection portion, a bumper means 5 arranged to collide with the lower surface of a piston to thereby absorb the shock of the piston produced by driving a nail, and an injection portion 6 for driving a nail fed by the nail feed means 4a.

The above-mentioned grip 3 is hollow with a compressed air intake 8 formed at a base end portion of the grip 3 in communication with a compressed air supply 7 where the other end portion 9 opposite to the compressed air intake 8 is opened. A first air path lo is formed above the other end portion 9 in FIG. 1 so that an end of a first movable pipe body 11 is slidably fitted into the first air path 10, and a trigger valve 14 is provided under the other end portion 9. Inside the grip 3, respective ends of a second movable pipe body 12 and a second air path 13 are connected with the above-mentioned compressed air intake 8. The second movable pipe body 12 is flexible, and projected outward at its other end from the grip 3 through the other end portion 9. The other end of the second air path 13 is connected to the first air path 10 through trigger valve 14.

Trigger valve 14 controls the supply and exhaust of compressed air to and from the first air path 10, and urges a valve stem 15 inward against spring force urging the valve stem 15 to the outside of the grip 3, so as to move a valve body 16 located in a position where the first air path 10 and the second air path 13 are connected to each other to a position where the second air path is closed and the compressed air in the first air path 10 is exhausted from an outer circumferential portion of the valve stem 15 into the atmosphere. A trigger lever 42 is disposed in opposition to a contact arm 17 provided on the nailing machine body 1.

Figure 2:
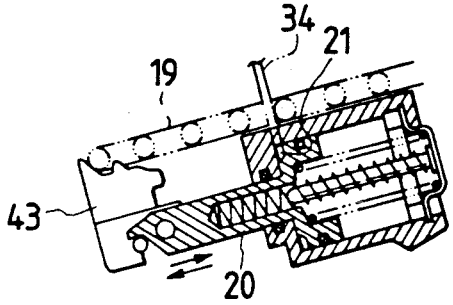
FIG. 2 is a section in plane for explaining a nail feeding device of a magazine of the nailing machine.

A housing portion 18 for housing coil-like connected nails and a nail path 19 extended from the housing portion 18 to the nail injection portion 6 are provided under the grip 3. Nail magazine 4 provided with the nail feed means 4a is disposed in the vicinity of a forward end portion of the nail path 19. As shown in FIG. 2, the nail feed means 4a is arranged so that the nail feed means 4a is supplied with compressed air through an opening portion 21 thereby pushing a feed piston 20 against spring force in the nail feed direction back into a nail feed cylinder 1. As a result a feed pawl 43 rotatably provided in the forward end of the feed piston 20 is moved from side to side as shown in FIG. 2, to thereby feed the connected nails in the nail path 19 forward one by one.

Injection portion 6 is provided with a nail-driving path 22 opened to the forward-end of the nail path 19 of the nail magazine 4. An urging member 17a of the contact arm 17 is disposed in the forward end of injection outlet of the injection portion 6. Further, a large-diameter portion 23 and a small diameter portion 24 are formed integrally with each other through a step portion 44 at a base portion (as seen in FIG. 1) of the injection portion 6, and the bumper means 5 is provided inside the large-diameter portion 23.

Cylinder housing 2 includes therein an integral combination of a piston 26 provided with a driver 25 for driving a nail, a cylinder 27 slidably housing the piston 26, and a head valve 28 for controlling the entrance and exit of compressed air into and out of the cylinder 27. Cylinder housing 2 is arranged to be movable in the injection direction of a nail.

Nail driver 25 faces the above-mentioned injection portion 6 of the nailing machine body 1, and the piston 26 is disposed so that its lower side is opposite to the bumper means 5 of the nailing machine body 1.

An opening 29 is formed in the side wall of the cylinder housing 2 opposite to the grip 3. A main air chamber 30 and a blow-back air chamber 31 are formed between the cylinder 27 and the cylinder housing 2. Opening 29 communicates with the main air chamber 30. An end portion of the second movable pipe body 12 is fitted in the opening 29. Main air chamber 30 communicates with cylinder 27 through a compressed air flow-in opening portion 32. The blow-back air chamber 31 communicates with the inside of the cylinder 27 through a through hole 33, and communicates with the opening portion 21 of the nail feed means 4*a* through a flexible third movable pipe body 34.

Head valve 28 is disposed above cylinder 27. One end (upper surface in FIG. 1) of a valve body 35 housed in a valve cylinder 36 is disposed in a head valve upper room 36*a*, and the other end (lower surface in FIG. 1) is disposed to face the compressed air flow-in opening portion 32 so as to be opposite to the main air chamber 30. Upper room 36*a* of head valve 28 communicates with the first air path 10 of the nailing machine body 1 through the first movable pipe body 11. One end portion of the first movable pipe body 11 is fixed in the head valve upper room 36*a*, and the other end portion is slidably fitted in the first air path 10. Head valve 28 closes the compressed air flow-in opening portion 32 by the pressure difference between the air pressure applied from the first movable pipe body 11 to one end of the valve body 35 and air pressure applied from the main air chamber 30 to the other end of the valve body 35 when the compressed air is supplied from the first movable pipe body 11 to the upper room 36*a*. Head valve 28 opens the compressed air flow-in opening portion 32 by the inversion of the pressure difference between air pressure applied from the first movable pipe body 11 to one end of the valve body 35 and air pressure applied from the main air chamber 30 to the other end of the valve body 35 when the compressed air is exhausted from the upper room 36*a* to the first movable pipe body 11. Therefore, head valve 28 controls the entrance and exit of compressed air from and to the main air chamber 30 to and from the cylinder 27.

An exhaust valve 37 is arranged to exhaust compressed air which has been supplied from the main air chamber 30 into the cylinder 27, through an exhaust hole 38. The upper surface of the piston 26 communicate with the atmosphere when the head valve 28 is at its bottom dead point. That is, the exhaust valve 37 is linked with head valve 28 through a spring 39 so that exhaust valve 37 is normally positioned so that exhaust hole 38 is open. The exhaust valve is moved into another position when exhaust hole 38 is closed. The exhaust valve is moved by spring force when the head valve 28 opens the compressed air flow-in opening portion 32.

On the nailing-side end portion of the cylinder housing 2, a cylindrical portion 40 is formed coaxially with the driver 25, and an inner step portion 44 is formed at its forward end between a large-diameter portion 23 and a small-diameter portion 24 of the nail body 1. Cylindrical portion 40 encloses the large-diameter portion 23 and the small-diameter portion 24 cf the nailing machine body 1 from the outside thereof. A compression spring 41 is formed between the step portion 44 and a step portion 45 at the forward end of the cylindrical portion 40 of the cylinder housing 2. Therefore, nailing machine body 1 and the cylinder housing 2 are coupled with each other so as to be movable in the nail-driving direction against the compression spring 41, and the positional relationship between the nailing machine body 1 and the cylinder housing 2 is kept constant by the compression spring 41, so that the compression spring 41 functions as a positioning means.

In operation, prior to the nail-driving operation, compressed air from the compressed air supply source 7 is supplied not only to the main air chamber 30 but also to the head valve upper room 36*a* through the second air path 13 and the first air path 10, respectively, by the trigger valve 14. Therefore, the opening portion 32 between the cylinder 27 and the main air chamber 30 is kept closed by the valve body 35. Next, if the trigger lever 42 is pulled while urging the forward end of the injection portion 6 of the nailing machine body 1 as well as the contact arm 17 onto the surface of a driven material, the trigger valve 14 is actuated to exhaust compressed air in the head valve upper room 36*a*. Therefore, the valve body 35 of the head valve 28 moves into the position where the opening portion 32 is opened to thereby supply compressed air from the main air chamber 30 into the cylinder 27. Compressed air acts on the upper surface of piston 26 so that piston 26 is driven downward to thereby drive a nail fed to the injection portion 6 into the driven member. However, if the compressed air is supplied into the cylinder 27, the compressed air acts not only on the upper surface of the piston 26 but also on the upper bottom surface of the cylinder 27 by the reaction force of the air pressure therein, so that the cylinder housing 2 is lifted in the direction opposite to the nail-driving direction. Although cylinder housing 2 jumps up as a result of spring force, the injection portion 6 formed integrally with the nailing machine body 1 is kept in contact with the surface of the driven material because the cylinder housing 2 and the nailing machine body 1 are combined in the above-mentioned manner. Thus, impact in driving a nail is absorbed so that it is always possible to perform accurate nailing. Further, since the nailing machine body 1 does not move relative to the surface being nailed, not only is it unnecessary to support the nailing machine body 1 by hand, but also it is always possible to drive a nail to a constant depth since the driving depth does not change in accordance with the condition of whether the nailing machine body 1 is supported by hand or not.

Air inside cylinder 27 below the piston 26 is compressed and fed into the blow-back air chamber 31 through the through hole 33 when the piston 26 is driven downward, so that the compressed air is supplied from the third movable pipe body 34 to the cylindrical portion 40 to thereby actuate the feed piston 20 to supply a next nail into the injection portion 6 after the above mentioned nail-driving operation.

When the cylinder housing 2 moves relative to the nailing machine body 1 as described above, the second and third movable pipe bodies 12 and 34 easily follows the above-mentioned relative movement, and the first movable pipe body 11 connecting the upper room 36a of the head valve 28 to the trigger valve 14 absorbs the above-mentioned relative movement by sliding within the first air path 10.

Further, since the nailing machine body 1 and the cylinder housing 2 are positioned in a predetermined relative position by the compression spring 41 after the nail-driving operation, it is possible to always perform the operation of the nailing machine smoothly.

Additionally, the range of movement of the cylinder housing 2 relative to the nailing machine body 1 is established so that the piston 26 is driven in the driving direction to hit the bumper means 5 before the cylinder housing 2 moves and reaches its top dead point. This is because the nailing machine body 1 may be lifted after the piston 26 hits the bumper means 5 if the cylinder housing 2 has already moved and reached its stop dead point when the piston 26 hits on the bumper means 5.

A second embodiment of the present invention will be described with reference to the drawings.

Figure 3:
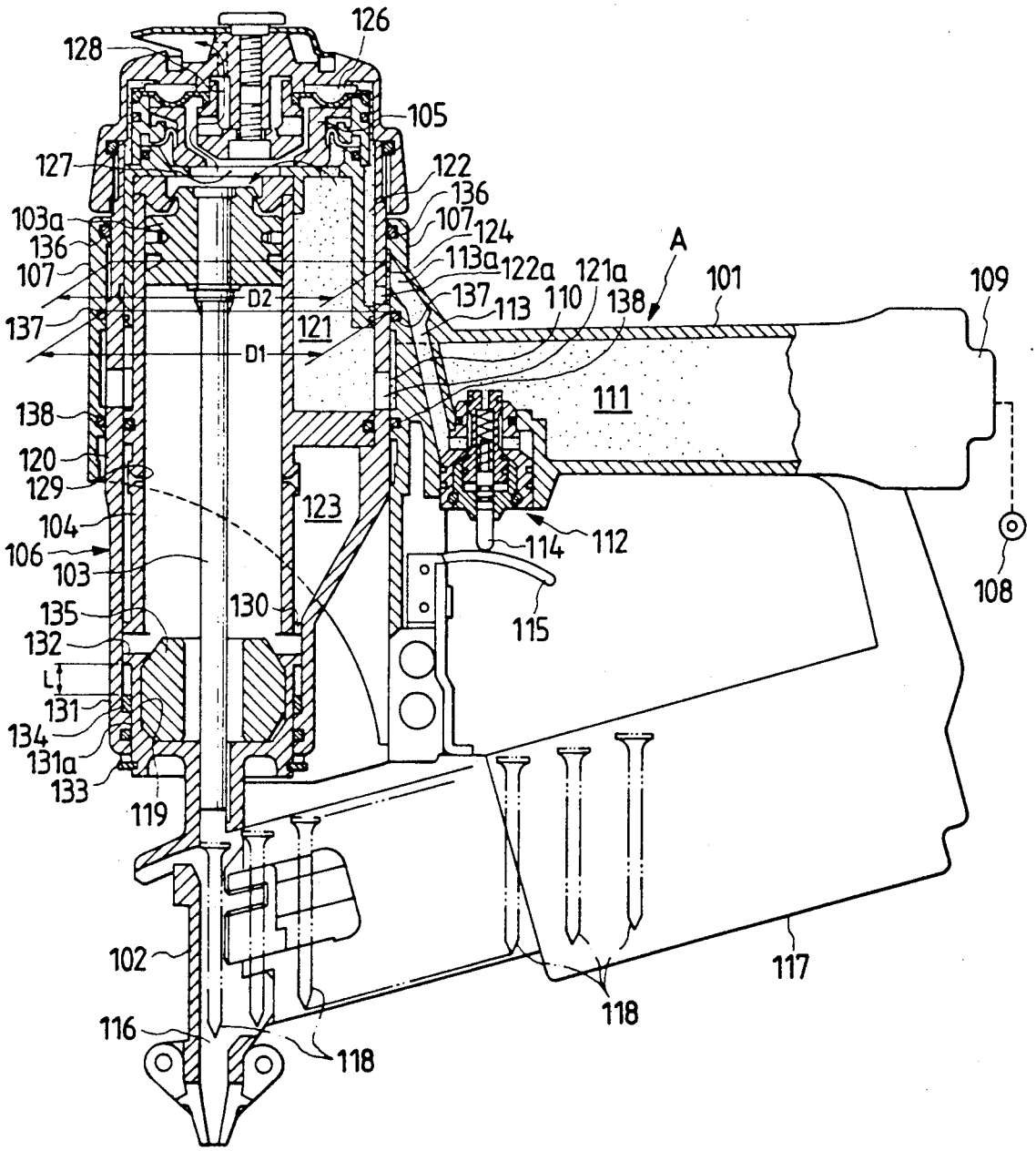
FIG. 3 is a longitudinal section of a non-reaction nailing machine as a second embodiment according to the present invention.

FIG. 3 illustrates a non-reaction nailing machine A. This nailing machine A is arranged to be driven by compressed air. In the machine A, a grip portion 101 and a nose portion 102 are formed integrally with each other. A body 106 provided with a cylinder 104 slidably housing a nail-driving member 103 and a head valve 105 for controlling driving air for the nail-driving member 103 is supported slidably in the nail-driving direction by an annular portion 107 formed in the grip portion 101.

A connection intake 109 arranged to be connected to a compressed air supply source 108 is formed to open in a base end portion of the grip portion 101, and an air outlet 110 is formed to open in the other end portion, so that the connection intake 109 and the air outlet 110 communicate with inside air chambers 111 respectively. A trigger valve 112 is provided in the grip portion 101. The trigger valve 112 is connected to one end of a first starting air path 113. The other end 113a of the first starting air path 113 opens to a portion above the air outlet 110.

The trigger valve 112 controls the supply and exhaust of compressed air inside the first starting air path 113, is arranged to selectively open and close the first starting air path 113 to the air chamber 111 or the atmosphere by pressing and disconnecting, by means of a trigger lever 115, a valve stem 114 which is urged outward by spring force.

The annular portion 107 is formed integrally on a side portion of the grip portion 101, and the air outlet 110 and the first starting air path 113 open in the inner wall of the annular portion 107.

The nose portion 102 is disposed below the annular portion 107 and formed integrally with the grip portion 101 together with a magazine 117. An injection outlet 116 is formed in the upper and lower direction in the nose portion 102, and connected nails 118 in the magazine 117 are fed to the injection outlet 116 by a nail feed mechanism (not shown). A large-diameter portion 119 housing a bumper means 135 therein is formed in a base portion (shown in the upper portion of FIG. 1) of the injection outlet 116.

Body 106, the head valve 105 and the cylinder 104 slidably housing the nail-driving member 103 in a cylinder housing 120 are disposed in integral combination with each other. A main air chamber 121 is formed between the cylinder 104 and the cylinder housing 120, and a second starting air path 122 and a blow-back air chamber 123 are formed respectively above and below the main air chamber 121. Moreover, opening portions 121a and 122a communicating with the main air chamber 121 and the second starting air path 122 are formed in the cylinder housing 120.

The head valve 105 is made of an elastic material and provided in a portion of the nail machine A above the cylinder 104. The upper surface of the head valve 105 faces an upper room 126 communicating with the second starting air path 122. A circumferential edge portion of the lower surface of head valve 105 and an opening portion of the center of the lower surface of head valve 105 respectively face the main air chamber 121 and a forward end opening portion 127 of the cylinder 104. The head valve 105 is opened or closed by the pressure difference produced between the upper and lower surfaces by the supply or exhaust of starting air, so that the cylinder 104 is connected with the main air chamber 121 or an exhaust path 128 selectively. That is, the head valve 105 closes the cylinder 104 to the main air chamber 121 as shown in FIG. 3 when the above-mentioned starting air is supplied, and the head valve 105 moves downward to thereby close the cylinder 104 to the exhaust path 128 and open it to the main air chamber 121 when the starting air is exhausted.

The blow-back air chamber 123 is arranged to communicate with the inside of the cylinder 104 through upper and lower through holes 129 and 130 so as to temporarily store compressed air compressed in the cylinder 104 by the lower surface of the nail-driving member 103a of the nail-driving member 103 and led through the upper and lower through holes 129 and 130 into the cylinder 104 by nail-driving operation by means of the nail-driving member 103. The stored compressed air is applied to the lower surface of the nail-driving member 103 through the lower through-hole 130 to thereby return the nail-driving member 103 to its upper dead point after the nail-driving member 103 has reached its lower dead point and the above mentioned cylinder 104 has opened to the exhaust path 128.

The body 106 is fitted in and supported by the annular portion 107 of the grip portion 101, and a compressed air communication air chamber 124 is formed between the grip portion 101 and the body 106.

The upper, center and lower slide seals 136, 137 and 138 are disposed between the body 106 and the annular portion 107 in a fit portion. When the body 106 slides in the annular portion 107 within the above-mentioned range, the opening portion 113a of the first starting air path 113 and the second starting air path 122a of the second starting air path 122 face each other through the communication air chamber 124 between the upper slide seal 136 and the central slide seal 137. The air outlet 110 of the air chamber 111 of the grip portion 101 and the opening end 121a of the main air chamber 121 of the body 106 face each other between the central slide seal 137 and the lower slide seal 138. The first starting air path 113 and the air chamber 111 therefore communicate with the second starting air path 122 and the main air chamber 121 respectively.

An outer diameter D1 of a portion of the cylinder housing 120 restricting a lower portion of the second starting air path 122 is formed to be larger than an outer diameter D2 of another portion of the cylinder housing. Consequently a difference in effective area effected by compressed air is formed in the communication air chamber 124, so that the force urging the cylinder housing 120 downward acts by the difference in effective area on the basis of the above-mentioned diameter difference when compressed air is supplied into the communication air chamber 124.

The above-mentioned body 106 is supported so as to be slidable in the nail-driving direction toward the nose portion 102 and fitted in and supported by the annular portion 107 of the grip portion 101. The large-diameter portion 119 of the nose portion 102 is fitted in a cylindrical portion 131 formed in a nailing-side end portion of the cylinder housing 120 of the body 106, so that the body 106 can slide within a range L where an inner annular step portion 131*a* of the forward end of the cylindrical portion 131 is engaged by engagement projecting edges 132 and 133 formed in upper and lower portions of the outer circumference of the large-diameter portion 119. When the body 108 is supported by the nose portion 102, the nail-driving member 103 in the cylinder 104 is provided to face the injection outlet 116 of the upper room 126 of the body 106, and the lower surface of the piston portion 103*a* is disposed in opposition to the bumper means 135 of the body 106.

In operation, prior to the nail-driving operation, compressed air from the compressed air supply source 108 is supplied not only to the air chamber 111 but also to the upper room 126 of the head valve 105 through the trigger valve 112 and the first starting air path 113. The head valve 105 is therefore kept in a position to close the cylinder 104 to the main air chamber 121 and open the cylinder 104 to the exhaust path 128. Next, when the forward end of the nose portion 102 of the body 106 is urged onto the surface of a driven material and the trigger lever 115 is pulled to thereby actuate the trigger valve 112, compressed air in the upper room 126 of the head valve 105 is exhausted and the head valve 105 moves to a position so that the cylinder 104 is closed to the exhaust path 128 and open to the main air chamber 121. Therefore, compressed air is supplied from the main air chamber 121 into the cylinder 104. Since the compressed air acts on the upper surface of the piston portion 103*a* of the nail-driving member 103, the piston portion 103*a* is driven downward to hit a nail 118 in the injection outlet 116. Nail 118 is the forward one of the connected nails 118 fed into the nose portion 102.

Figure 4:
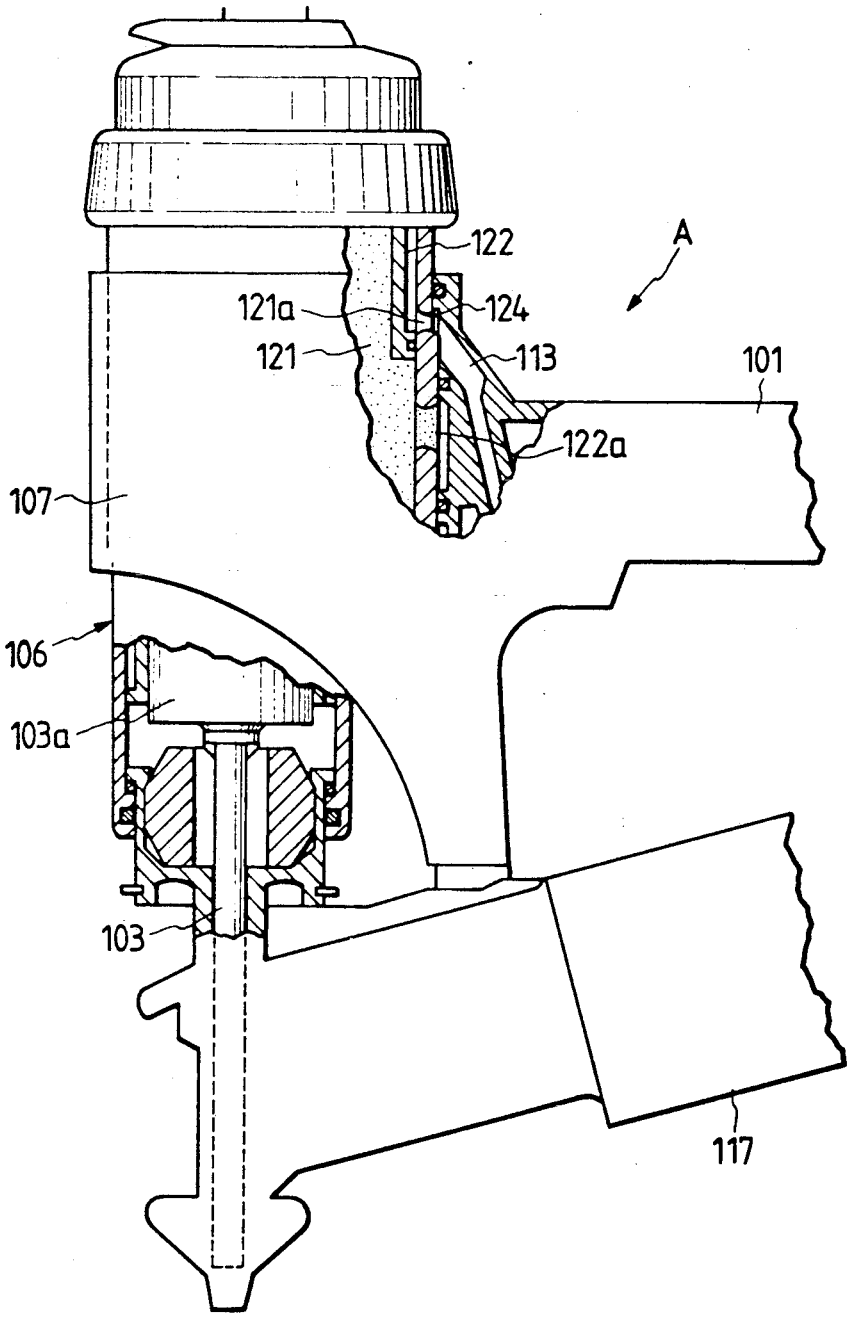
FIG. 4 is an explanatory view partly in section showing a main part in relative movement of a body.

When compressed air is supplied into the cylinder 104, the compressed air acts not only on the upper surface of the piston portion 103*a* but also on the upper bottom surface of the cylinder 104 by reaction force of the air pressure therein. Therefore, the body 106 is lifted in the direction opposite to the direction of driving the nail 118 as shown in FIG. 4. Since the above-mentioned reaction force does not however affect the grip portion 101 and the nose portion 102, the nose portion 102 is kept in contact with the surface of the driven material. Therefore, action upon driving a nail is absorbed so that it is always possible to perform accurate nailing. It is further possible to slide the body 106 stably since the body 106 is supported by the nose portion 102 and the annular portion 107.

Even if the body 106 slides relative to the grip portion 101 and the nose portion 102, the first starting air path 113 and the air chamber 111 in the grip portion 101 communicate respectively with the second starting air path 122 and the main air chamber 121 through the slide seals 136, 137 and 138 within the range of movement of the body 106, so that the above-mentioned communication is maintained.

When the trigger valve 112 is released after driving a nail, compressed air in the air chamber 111 is supplied through first starting air path 113 and the second starting air path 122 into the upper room 126 of the head valve 105 so that the head valve 105 moves into the position to make the cylinder 104 open to the exhaust path 128 and close to the main air chamber 121. Consequently, while compressed air in the cylinder 104 is exhausted through the exhaust path 128, air in the blowback air chamber 123 acts on the lower surface of the piston portion 103*a* of the nail-driving member 103 so as to return the nail-driving member 103 to its upper dead point.

If compressed air is supplied into the second starting air path 122 of the body 106, the body 106 is urged downward by the difference in effective area between the upper and lower pressure applied surfaces on the basis of the outer diameters D1 and D2 of the cylinder housing 120 forming the communication air chamber 124, so as to return the cylinder housing 120 to an initial position in FIG. 3 again. Further, by the supply of a nail into the nose portion 102 by the nail feed mechanism, the next nailing is prepared.

As has been described above, even if the body 106 slides relative to the grip portion 101 and the nose portion 102, the body 106 is supported by the nose portion 102 and the annular portion 107, so that the body 106 is stably supported.

As have been described above, the communication air chamber 124 is formed between the grip portion 101 and the body 106, so that the communication between the grip portion 101 side and the body 106 side can be kept even though the body 106 moves relative to the grip portion 101. Because air supply and exhaust between the grip portion 101 and the body 106 can be made without provision of an outside piping, the body 106 is slid smoothly, thereby making maintenance easy and improving durability.

Because the difference in effective area of the compressed air is formed in the communication chamber 124, the body 106 which has moved at the time of nailing is returned to the initial position by supplying compressed air to the communication air chamber. For this reason, it is not necessary to provide a compression spring to urge the body 106 to return to its initial position as is done in the conventional nailing machine. Consequently, the machine can be smaller.

Since compressed air in the communication air chamber 124 is released into the atmosphere by the trigger valve 112 in nailing a nail, the urging force due to the difference in effective area is also released. The above-mentioned difference in effective area therefore becomes no burden on the relative movement of the body 106. It is therefore performed smoothly.

As has been described above, the first starting air path 113 and the air chamber 111 in the grip portion 101 communicate respectively with the second starting air path 122 and the main air chamber 121 through the slide seals 136, 137 and 138 within the range of the above-mentioned relative movement so that the above-mentioned communication is maintained even if the body 106 moves relatively. It is therefore possible that the sides of the grip portion 101 and the body 106 communicate with each other with respect to the supply and exhaust of air, so that body 106 slides smoothly to thereby improve its durability as well as make its maintenance.

A third embodiment of the present invention will be described with reference to the drawings.

Figure 5:
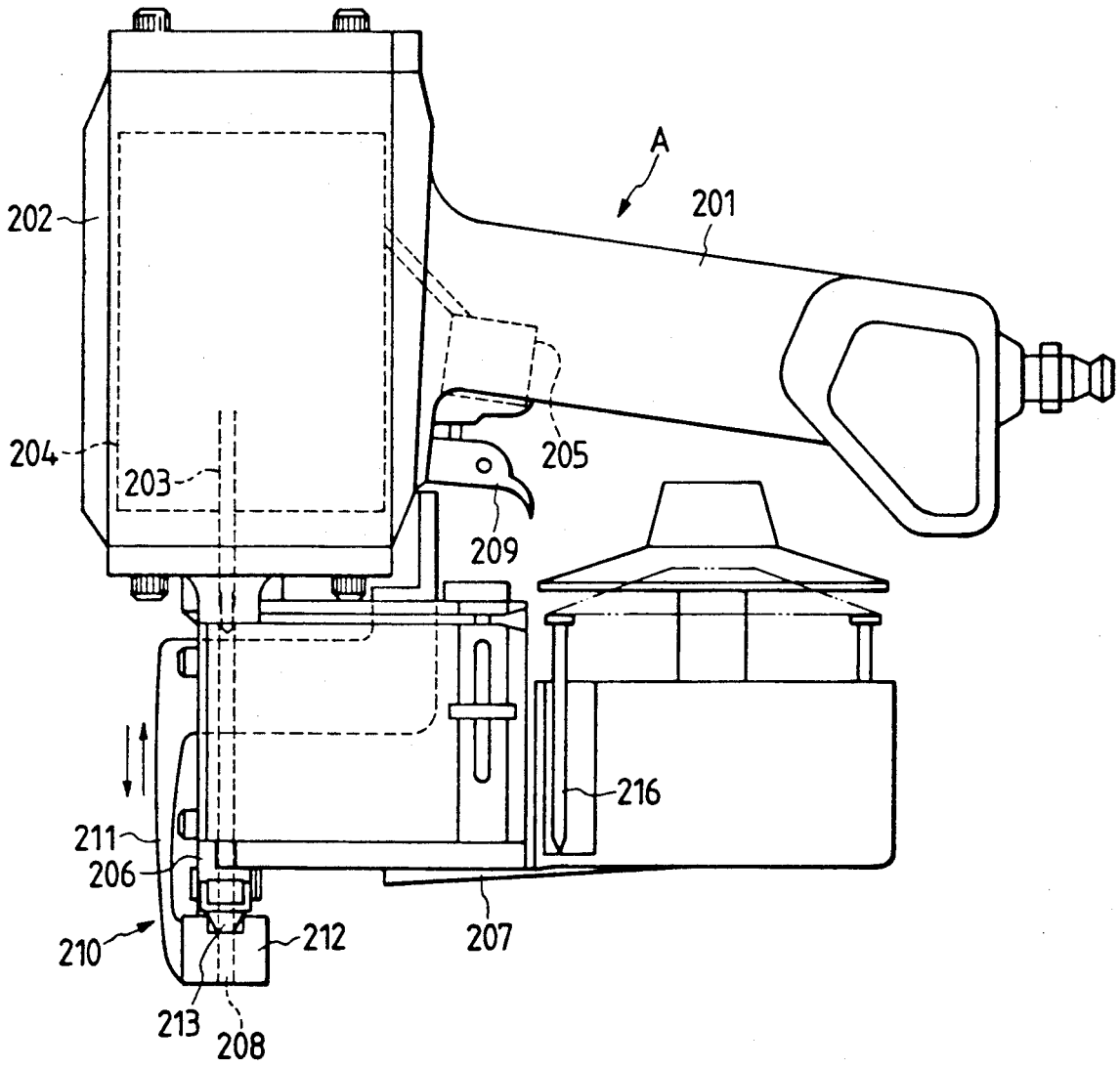
FIG. 5 is a side view showing the whole of the nailing machine.

FIG. 5 illustrates a nailing machine A. In the nailing machine A, a body portion 202 is provided in the front portion of a grip portion 201 to be connected to a compression air supply source. A drive mechanism 204 for driving a nail impact driver member 203 by compressed air and a starting valve 205 for controlling the operation of the drive mechanism 204 are provided in the body portion 202. A nose portion 206 is further provided in the lower end of the body portion 202, and a driving path 208 opened to a nail supply portion 207 and for slidably housing the driver member 203 is formed inside the nose portion 206. The drive mechanism 204 as well as the starting valve 205 are actuated by operating a trigger lever 209 after a nail is fed from the nail supply portion 207 into the driving path 208, so that the nail is driven out by impact by the driver member 203 driven thereby.

A safety device 210 is provided in the nailing machine A so that a nail magazine cannot be actuated without operating the trigger lever 209. Similarly to that employed in the conventional nailing machine, the safety device 210 has an arrangement in which a contact arm 211 is provided slidably in the axial direction of the nose portion 206, and the base end of the contact arm 211 is disposed opposite to the trigger lever 209 and at a forward end portion of the nose portion 206. Therefore that the operation of the trigger lever 209 cannot become effective before the base end of the contact arm 211 urges the trigger lever 209 by the slide of the contact arm 211 due to engaging and urging the forward end engagement portion 212 onto the surface of a driven material.

The forward end engagement portion 212 of the contact arm 211 constituting the safety device 210 is formed in a cylindrical shape and disposed to enclose the nose portion 206. The forward end engagement portion 212 is normally disposed in a more projected position than the forward end of the nose portion 206, and movable is in the axial direction of the nose portion 208 while engaging the surface of a driven material.

Figure 6:
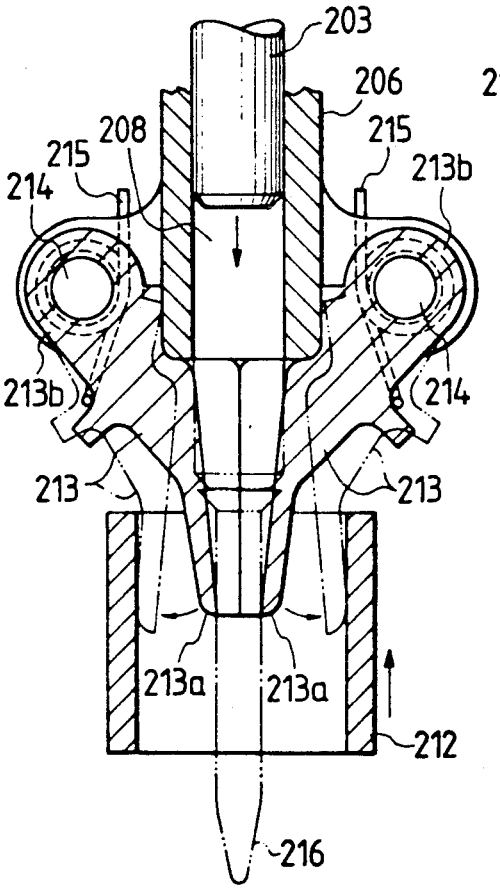
FIG. 6 is a longitudinal side view in section of a nail holder of a nailing machine of as a third embodiment according to the present invention.
Figure 7:
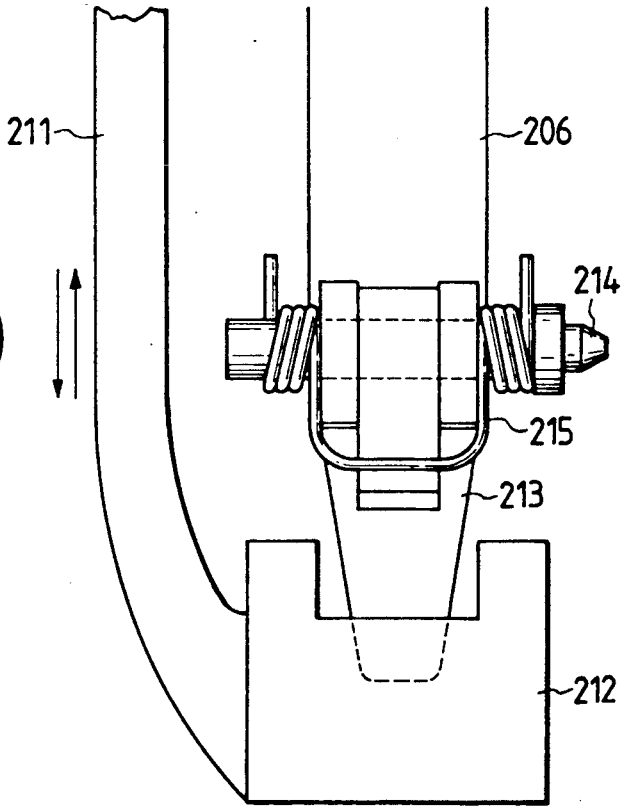
FIG. 7 is a front view of the nail holder.

As is shown in FIGS. 6 and 7, two guide elements 213 are provided in a forward end outer circumferential portion of the nose portion 206. Forward end portions 213*a* of the respective guide elements 213 are projected further than the forward end of the nose portion 206. Base portions 213*b* are attached pivotally to pivots 214 provided in the nose portion 206. The guide elements 213*a* of these guide elements 213 are provided in a position (a position indicated by a solid line in FIG. 6) to close by the advance in the direction of extension of the driving path 208 of the nose portion 206 and a position (a position indicated by a dotted line in FIG. 6) to open by retreat in the direction of extension of the driving path 208. Torsion coil springs 215 are attached to the respective pivots 214, so that the torsion coil springs 215 urge the respective guide elements 213 in the closed direction. When the guide elements 213 are in a closed state, the interiors of the forward end portions 213*a* of the respective guide elements 213 are formed in a tapered shape.

The guide elements 213 may be provided in plural, two or more in number, and means for urging the guide elements 213 into a closed state are not limited to the torsion coil springs 215 but may be any elastic means.

Further, the guide elements 213 are disposed at a more inner side than the engagement portion 212 of the safety device 210 and formed so that the engagement portion 212 houses the guide elements 213 in its inside when the engagement portion 212 moves in the axial direction of the nose portion 206 while engaging the surface of a driven material.

Generally, connected nails 216 constituted by a plurality of nails 216 connected with each other through a connection member are used.

In the above-mentioned arrangement, nail 216 is fitted into the driving path 208 of the nose portion 206 when the nail 216 is driven. Next, the engagement portion 212 of the safety device 210 engages the surface of a driven material and is urged thereon. The engagement portion 212 is moved in the axial direction of the nose portion 206, so that the safety device 210 is released. The driver member 203 is driven by the release operation of the safety device 210 and the start operation (the pull operation of the trigger lever 209) to impact the nail 216. The forward end of the impacted nail 216 is received by the forward end portions of the guide elements 213 when the nail 216 is hit out from the forward end of the driving path 208. Therefore, the axial portion of the nail 216 is kept in the central position of the driving path 208. The nail 216 is therefore hit accurately in the axial direction of the nose portion 206.

When the nail 216 is hit by the driver member 203, the nail 216 urges and opens the guide elements 213 so that the guide elements 213 are opened suddenly. However, the guide elements 213 are received by the inner surface of the engagement portion 212 at that time so as to limit more open operation. Therefore, the torsion coil springs 215 urging the guide elements 213 are not given a violent burden which exceeds its elastic limit, so that its durability is improved.

Moreover, a forward end engagement portion 212 of a safety device 210 provided in the conventional nailing machine may be used as it is for the forward end engagement portion 212 of the safety device 210, so that the outer shape of the nose portion 206 is not enlarged and its operativity is not deteriorated.

Further, the nail holder is effective particularly in the case of driving a nail having a large head diameter.

While the invention has been described in connection with what is presently considered to be the most practical and preferred embodiments, it is to be understood that the invention is not limited to the disclosed embodiment but, on the contrary is intended to cover various modifications and equivalent arrangements included within the spirit and scope of the appended claims.

We claim:

1. A nailing machine comprising:

a cylinder housing defined in surrounding relation to a piston provided with a driver for driving a nail, a cylinder which slidably houses said piston, and a head valve for controlling supply and exhaust of compressed fluid into and from said cylinder; and a nailing machine body including a grip, a nail magazine, a nail feed means for feeding a nail from said nail magazine to a nail injection portion for receiving a nail fed by said feed means from said magazine and driving out such nail, a bumper means fixedly mounted with respect to said nailing machine body and arranged to collide with a lower surface of said piston for absorbing impact of said piston at the time of nailing, said cylinder housing being supported on said nailing machine body so as to be movable with respect thereto along an axis in a nail-driving direction so that said piston within said cylinder can be driven downward by said compressed fluid so that said driver drives a nail, and a trigger valve being manually operated for remote controlling a head valve and a compressed fluid intake for receiving a compressed fluid from a compressed fluid supply source, in which said nailing machine further comprises:

a first movable communicating tube for connecting said trigger valve to an end of said head valve of said cylinder housing so as to give an nail-driving signal to said head valve; and a second movable communicating tube for connecting said compressed fluid intake with the other end of said head valve.

2. A nailing machine as in claim 1 wherein said nailing machine body integrally further includes a columned guide surface at an upper portion on said nail injection portion, and said cylinder housing integrally further includes a cylindrical guide surface for housing said columned guide surface at a lower portion of said cylinder housing, wherein said cylinder housing is supported to said nailing machine body by said columned guide surface and said cylindrical guide surface in such a manner that said cylinder housing is movable along the axis in the nail-driving direction.

3. A nailing machine as in claim 2 further comprising a positioning means for urging said nailing machine body and said cylinder housing into a predetermined relative position.

4. A nailing machine as in claim 3 wherein said positioning means is a compression spring and said cylinder housing moves relative to said nailing machine body along the axis in the nail-driving direction against the action of said compression spring.

5. A nailing machine as in claim 1 wherein said second movable communicating tube is flexible.

6. A nailing machine as in claim 5 wherein a first end of said first movable communicating tube is slidably disposed in a first air path running parallel with the axis in the nail-driving direction.

7. A nailing machine comprising a body and a grip member wherein:

said body comprises:

a cylinder having an opening portion at one end, a piston integrally provided with a driver for driving a nail and slidably housed in said cylinder, a head valve for controlling the opening and closing of said opening portion of said cylinder, and a cylindrical housing defined in surrounding relation to said cylinder, said piston and said head valve; and said grip member comprises:

a nose member having a nail outlet to which a nail is disposed for being driven and through which said driver for driving the nail is slidably moved, a bumper means fixedly coupled to an upper end of said nose member for engaging said piston, and a guide surface formed as an inner peripheral surface of a cylinder housing surrounding said cylindrical housing of said body, said nose member being fixed with respect to said guide surface, wherein an outer peripheral surface of said cylindrical housing is movably supported along an axis parallel to the nail driving direction by said guide surface, so that said body is supported by said grip member.

8. A nailing machine as in claim 7 further comprising an annular communication air chamber provided between said guide surface of said grip member and said outer peripheral surface of said housing and a difference in effective area defined between an upper and a lower surface of said air chamber, so that said body is urged to a nail-driving side by an air compression at all times.

9. A nailing machine as in claim 8 wherein:

said grip member further comprises a trigger valve for controlling the supplying and the exhausting of a compressed air for operating said head valve, said trigger valve being manually operable, and said annular chamber is disposed on an air path for communicating said trigger valve and said head valve.

10. A nailing machine as in claim 7 wherein:

said body further comprises an air chamber defined on an outer peripheral surface of said cylinder for accumulating a pressure of a compressed air for driving a piston, and said grip member further comprises a hollow portion connected to a compressed air supply source and a trigger valve manually operable for supplying and exhausting said compressed air for operating said head valve, in which said nailing machine further comprises an air path defined by slide seals between said guide surface of said cylindrical housing of said body and an outer peripheral surface of said housing so as to connect said trigger valve and said hollow portion to said head valve and said chamber.

11. A nailing machine as in claim 10 wherein:

two annular recess portions defined by said slide seals along an axis parallel to a nail-driving direction are provided within said guide surface of said grip member so as to connect with said hollow portion and with said trigger valve, respectively, two opening portion opposed to said two annular recess portions and isolated from each other in the axial direction are provided within said outer peripheral surface of said body so as to connect said recess portions with said head valve and with said chamber.

* * * * *